United States Patent [19]

Karls

[11] Patent Number: 4,925,412

[45] Date of Patent: May 15, 1990

[54] MARINE DRIVE WEED DEFLECTOR

[75] Inventor: Michael A. Karls, Hilbert, Wis.

[73] Assignee: Brunswick Corporation, Skokie, Ill.

[21] Appl. No.: 326,025

[22] Filed: Mar. 20, 1989

[51] Int. Cl.[5] ..... B63H 5/16

[52] U.S. Cl. ..... 440/71; 440/73

[58] Field of Search ..... 440/900, 71, 72, 73, 440/49

[56] References Cited

U.S. PATENT DOCUMENTS

| | | | |
|---|---|---|---|
| 2,054,374 | 9/1936 | Fuller | 440/71 |
| 2,135,162 | 11/1938 | Benson | 440/71 |
| 2,140,099 | 12/1938 | Wise | 440/71 |
| 2,244,217 | 6/1941 | Pries | 440/71 |
| 2,319,640 | 5/1943 | Sink | 440/72 |
| 2,355,842 | 8/1944 | Arado | 440/71 |
| 2,470,874 | 5/1949 | Sidney | 440/71 |
| 2,894,477 | 7/1959 | Brown | 440/71 |
| 3,025,825 | 3/1962 | Martinson | 440/72 |
| 3,035,538 | 5/1962 | Willard | 440/71 |
| 4,565,533 | 1/1986 | Springer | 440/71 |
| 4,680,017 | 7/1987 | Eller | 440/71 |
| 4,718,871 | 1/1988 | Mendelelvitch | 440/71 |

*Primary Examiner*—Joseph F. Peters, Jr.
*Assistant Examiner*—Edwin L. Swinehart
*Attorney, Agent, or Firm*—Andrus, Sceales, Starke & Sawall

[57] ABSTRACT

A weed deflector (28) is provided by a bar (30) mounted to the driveshaft housing (12) of a marine drive (10). The bar (30) has a top portion (46) extending forwardly from the driveshaft housing (12) to a forward leading tip (32) and has a lower portion (38) bent downwardly and rearwardly and tapered back to and mounted to the driveshaft housing (12). The space (34) between the forward leading tip (32) and the driveshaft housing (12) is open so that it does not affect steering of the marine drive (10). The tapered portion (38) of the bar (30) forces weeds to slide downwardly and rearwardly therealong and off of the driveshaft housing (12). The bar (30) prevents weeds from wrapping around the strut portion (14) and covering cooling water inlets (20) or interfering with the propeller (22) or propeller efficiency.

10 Claims, 1 Drawing Sheet

MARINE DRIVE WEED DEFLECTOR

BACKGROUND AND SUMMARY

The invention relates to weed deflectors for marine drives.

The invention provides a particularly simple and effective weed deflector which may be added to a conventional marine drive. For background art, reference is made to U.S. Pat. Nos. 2,054,374, 2,135,162, 2,244,217, 2,319,640, 2,470,874, 2,894,477, 3,025,825, 3,035,538, 4,565,533, and 4,680,017.

DETAILED DESCRIPTION

Figure 1:
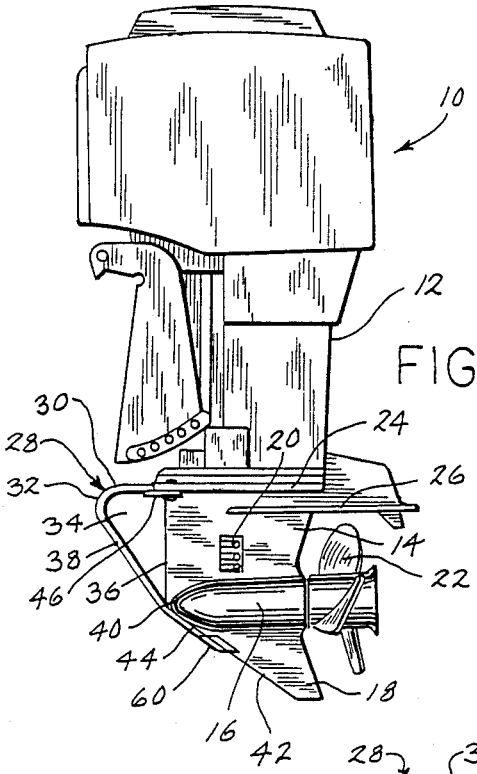
FIG. 1 shows a marine drive with a weed deflector in accordance with the invention.
Figure 3:
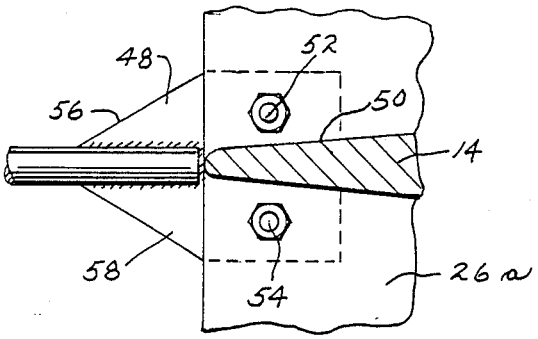
FIG. 3 is a sectional view taken along line 3—3 of FIG. 2.

FIG. 1 shows a marine drive 10 having a lower depending driveshaft housing 12 including a strut portion 14 extending downwardly to a gearcase or torpedo housing 16 having a lower depending skeg 18. Cooling water inlets 20 on the side of strut portion 14 supply cooling water to the marine drive. Propeller 22 at the rear of torpedo housing 16 propels the marine drive. Strut portion 14 of driveshaft housing 12 extends vertically downwardly and includes laterally extending anti-splash plate 24 and laterally extending anit-ventilation plate 26, as is standard in the art.

In accordance with the invention, weed deflector 28 comprises a bar 30 having a frontal surface area with a cross sectional width substantially no wider than the width of the leading edge of the drive shaft housing 36, and having a side surface area with a cross sectional width substantially the same as the cross sectional width of the frontal surface area. The bar 30 is mounted to driveshaft housing 12 of the marine drive and extends forwardly therefrom to a forward leading tip 32 and then tapers back to and is mounted to the driveshaft housing, preferably at gearcase 16 or skeg 18. The space 34 between the forward leading tip 32 of bar 30 and the leading edge 36 of strut portion 14 of driveshaft housing 12 is open so that it does not affect steering of the marine drive. The tapered portion 38 of the bar forces weeds to slide downwardly and rearwardly therealong off the driveshaft housing. Bar 30 prevents weeds from wrapping around strut portion 14 and covering cooling water inlets 20 or interfering with propeller 22 or propeller efficiency.

Torpedo housing 16 has a leading nose 40. Skeg 18 has a leading edge 42 extending downwardly and rearwardly from leading nose 40 of torpedo housing 16. Bar 30 extends downwardly and rearwardly at portion 44 past leading nose 40 of torpedo housing 16 and is mounted to leading edge 42 of skeg 18. The tapered portion of bar 30 has a first section as shown at 38 extending rectilinearly from forward leading tip 32 downwardly and rearwardly to leading nose 40 of torpedo housing 16 at a given angle to horizontal, and has a second section as shown at 44 extending downwardly and rearwardly along and parallel to leading edge 42 of skeg 18. Second section 44 of the tapered portion of bar 30 extends rectilinearly at a given angle to horizontal different than the noted angle of first section 38. Bar 30 extends substantially horizontally forwardly at portion 46 from driveshaft housing 12 to leading tip 32 parallel to water flow therepast and is integrally bent downwardly and rearwardly from leading tip 32 at portion 38. Bar 30 at forward leading tip 32 forms an acute angle substantially less than 90° between portion 46 and portion 38. Leading tip 32 at horizontal forward extension 46 of bar 30 is the forward-most spaced portion of the bar from driveshaft housing 12. Leading tip 32 is spaced above cooling water inlets 20.

Figure 2:
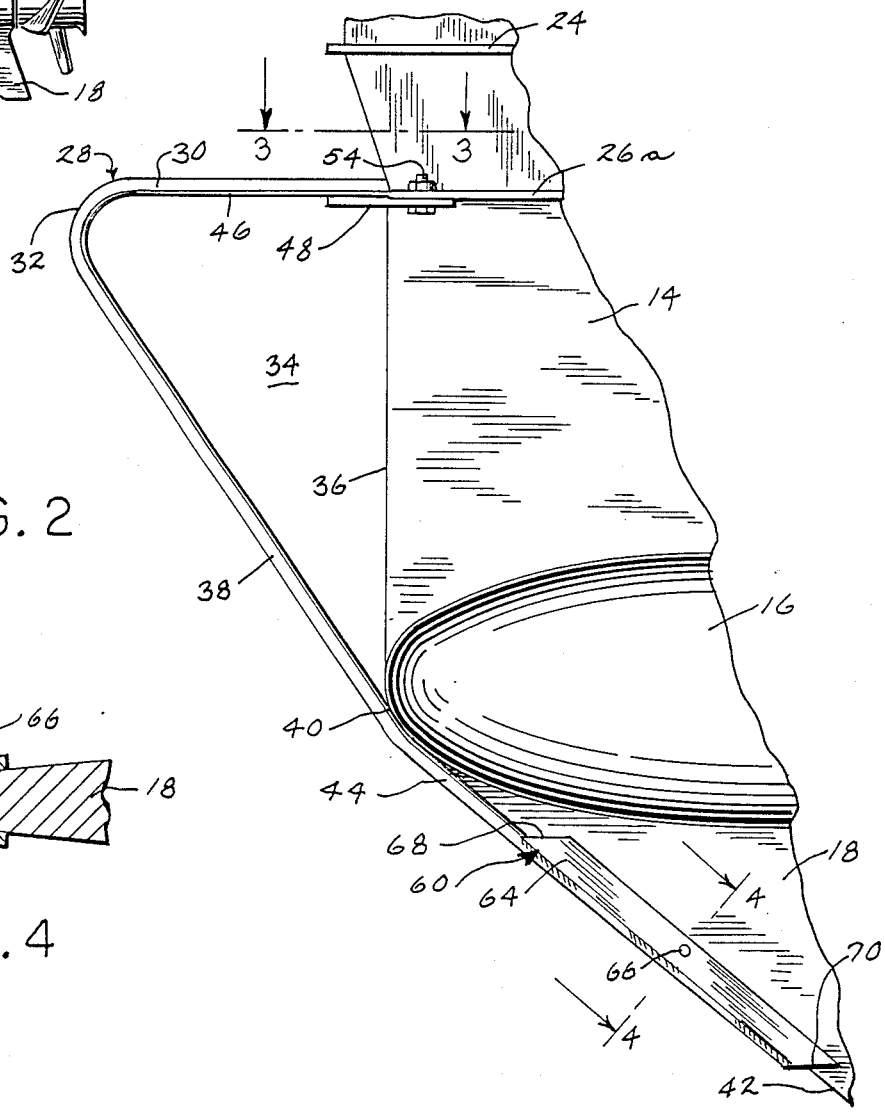
FIG. 2 is an enlarged view of a portion of FIG. 1 and shows a further embodiment.

Top portion 46 of bar 30 is mounted at upper mounting plate 48 to strut portion 14 of driveshaft housing 12 at anti-splash plate 24, FIG. 1, or to anti-ventilation plate **26*a*, FIG. 2, in those drives where the anti-ventilation plate is extended forwardly all the way to the front of the strut portion of the driveshaft housing. Mounting plate 48 is welded to bar 30 at top portion 46, and is bifurcated at notch 50 to stradle strut portion 14. Mounting plate 48 is mounted to anti-splash plate 24 or anti-ventilation plate 26*a* by bolts 52, 54. Mounting plate 48 is a flat planar horizontal member extending forwardly of leading strut portion edge 36. Mounting plate 48 has tapered leading edges 56 to 58 on each side of the top portion 46 of bar 30 welded thereto. Tapered leading edges 56 and 58** minimize water drag, and reduce cavitation burn on the driveshaft housing.

Figure 4:
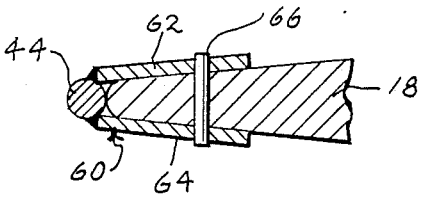
FIG. 4 is a sectional view taken along line 4—4 of FIG. 2.

Bar 30 is mounted to skeg 18 at leading edge 42 by a lower mounting plate 60 comprising a generally V-shaped member, FIG. 4, having legs 62 and 64 stradling skeg 18 and mounted thereto by pin 66. Legs 62 and 64 are welded to bar potion 44. Mounting plate 60 has upper and lower ends 68 and 70 which are tapered to be substantially horizontal when installed, such that ends 68 and 70 are substantially parallel to water flow therepast, and minimize water drag and cavitation burn on the driveshaft housing, including skeg 18.

It is recognized that various equivalents, alternatives and modifications are possible within the scope of the appended claims.

I claim:

1. In a marine drive having a lower depending driveshaft housing including a strut portion having a leading edge and a side and extending downwardly to a torpedo housing, cooling water inlets on the side of said strut portion for supplying cooling water to said marine drive, and a propeller at the rear of said torpedo housing for propelling said marine drive, a weed deflector comprising a bar counted to said driveshaft housing and having a top portion extending forwardly from said driveshaft housing and parallel to water flow therepast, said top portion extending forwardly to a forward leading tip, and having a lower portion bent downwardly and rearwardly at an angle from said forward leading tip and back to and mounted to said driveshaft housing, the space between said forward leading tip of said bar and said leading edge of said driveshaft housing being open so that it does not affect steering of said marine drive, said lower portion of said bar forcing weeds to slide downwardly and rearwardly therealong and off of said driveshaft housing, said bar preventing weeds from wrapping around said strut portion and covering said cooling water inlets or interfering with said propeller or propeller efficiency, said bar having a frontal surface area with a cross sectional width substantially no wider than said leading edge of said driveshaft housing, said bar having a side surface area with a cross sectional width substantially the same as the cross sectional width of said frontal surface area, such that the increase in drag and steering resistance is minimized.

2. The invention according to claim 1 wherein said driveshaft housing includes a skeg extending downwardly from said torpedo housing, said torpedo housing has a leading nose, said skeg has a leading edge extending downwardly and rearwardly from said leading nose of said torpedo housing, and wherein said bar extends downwardly and rearwardly past said leading nose of said torpedo housing and is mounted to said leading edge of said skeg.

3. The invention according to claim 2 wherein said lower portion of said bar has a first section extending rectilinearly from said forward leading tip downwardly and rearwardly to said leading nose of said torpedo housing at a given angle to horizontal, and has a second section extending downwardly and rearwardly along and parallel to said leading edge of said skeg.

4. The invention according to claim 3 wherein said second section of said lower portion of said bar extends rectilinearly at a given angle to horizontal different than said first mentioned angle.

5. The invention according to claim 1 wherein said top portion of said bar and said lower portion of said bar extend along axes which intersect at an acute angle substantially less than 90°.

6. The invention according to claim 5 wherein said bar is integrally bent downwardly and rearwardly from said leading tip, said leading tip being the forward-most spaced portion of said bar from said driveshaft housing, said leading tip being spaced forwardly and above said cooling water inlets.

7. In a marine drive having a lower depending driveshaft housing including a strut portion having a leading edge and a side and extending downwardly and having a laterally extending anti-splash plate and a laterally extending anti-ventilation plate, said strut portion extending downwardly to a torpedo housing, cooling water inlets on the side of said strut portion below said plates for supplying cooling water to said marine drive, a propeller at the rear of said torpedo housing for propelling said marine drive, a skeg extending downwardly from said torpedo housing, a weed deflector comprising a top portion extending forwardly from said driveshaft housing and parallel to water flow therepast, said top portion extending forwardly to a forward leading tip such that there is an open space between said forward leading tip and said leading edge of said driveshaft housing, and a lower portion extending downwardly and rearwardly at an angle from said tip and back to said driveshaft housing, an upper mounting plate mounting said deflector to one of said anti-splash and anti-ventilation plates, and lower mounting plate means mounting said deflector to said skeg, said bar having a frontal surface area with a cross sectional width substantially no wider than said leading edge of said driveshaft housing, said bar having a side surface area with a cross sectional width substantially the same as the cross sectional width of said frontal surface area, such that the increase in drag and steering resistance is minimized.

8. The invention according to claim 7 wherein said upper mounting plate comprises a bifurcated member stradling said driveshaft housing and mounted to said one of said anti-splash and anti-ventilation plates on both sides of said driveshaft housing.

9. The invention according to claim 8 wherein said upper mounting plate is a flat horizontal planar member extending forwardly beyond the leading edge of said strut portion and to which said deflector is attached.

10. In a marine drive having a lower depending driveshaft housing including a strut portion having a size and a leading edge and extending downwardly, said strut portion extending downwardly to a torpedo housing, a propeller at the rear of said torpedo housing for propelling said marine drive, a skeg extending downwardly from said torpedo housing, a weed deflector comprising a top portion extending forwardly from said driveshaft housing to a forward leading tip, and a lower portion extending downwardly and rearwardly from said tip and back to said driveshaft housing, an upper mounting plate mounting said deflector to said strut portion of said driveshaft housing, and lower mounting plate means mounting said deflector to said skeg and comprising generally V-shaped means extending along and stradling the leading edge of said skeg and mounted thereto and having upper and lower ends which are tapered to be substantially horizontal and parallel to water flow therepast when installed on said skeg.

* * * * *